United States Patent [19]

Numata et al.

[11] 4,060,788

[45] Nov. 29, 1977

[54] POTENTIOMETER

[75] Inventors: Saburo Numata; Shinichiro Fujino, both of Urawa, Japan

[73] Assignee: Fuji Photo Optical Co., Ltd., Omiya, Japan

[21] Appl. No.: 711,362

[22] Filed: Aug. 3, 1976

[30] Foreign Application Priority Data

Aug. 6, 1975 Japan ..... 50-95634

[51] Int. Cl.[2] ..... H01C 10/16

[52] U.S. Cl. ..... 338/128; 338/162; 338/176; 338/180

[58] Field of Search ..... 338/118, 128, 160, 162, 338/165, 176, 180, 181, 183

[56] References Cited

U.S. PATENT DOCUMENTS

| | | | |
|---|---|---|---|
| 3,061,807 | 10/1962 | Hollander, Jr. | 338/176 |
| 3,165,714 | 1/1965 | Dreyfus | 338/162 |
| 3,284,697 | 11/1966 | May | 338/180 X |

*Primary Examiner*—C. L. Albritton

*Attorney, Agent, or Firm*—Gerald J. Ferguson, Jr.; Joseph J. Baker

[57] ABSTRACT

A resistor having a high resistance and a resistor having a low resistance are arranged in parallel to each other in side by side relation. A pair of input terminals are fixed to both ends of the resistor of low resistance. A movable contact is provided in slidable contact with the resistor of high resistance moving along the edge of the resistor of low resistance which is in contact with an edge of the resistor of high resistance.

6 Claims, 5 Drawing Figures

POTENTIOMETER

BACKGROUND OF THE INVENTION

1. Field of the Invention

This invention relates to a potentiometer, and more particularly to a novel potentiometer which employs two kinds of resistors arranged in parallel to each other.

2. Description of the Prior Art

The conventional potentiometer has a single resistor which has input terminals at both ends thereof, and a movable contact slidable along the resistor. When the potentiometer is repeatedly used, the contact resistance between the movable contact and the resistor changes. Particularly in the case where the potentiometer is repeatedly used a great number of times as in a photographic camera wherein potentiometers are used for setting exposure information such as aperture size, shutter speed and film sensitivity in an automatic exposure control circuit, the contact resistance rapidly changes and accordingly the life of the potentiometers is short.

SUMMARY OF THE INVENTION

In view of the short life of the conventional potentiometers, the primary object of the present invention is to provide a potentiometer which has a high durability and a long life.

Another object of the present invention is to provide a potentiometer in which the surface of the resistor on which the movable contact slides has a high durability and accordingly the contact resistance does not readily change.

Still another object of the present invention is to provide a potentiometer in which the change in the contact resistance is negligible.

The potentiometer in accordance with the present invention is characterized in that a first resistor of low resistance and a second resistor of high resistance are arranged in side by side relation and in contact with each other. The first resistor of low resistance has input terminals at both ends thereof. A movable contact is slidable along the first and second resistors in slidable contact with the second resistor of high resistance.

Since the movable contact slides on the second resistor of high resistance, the amount of electric current flowing through the contact point is small and accordingly the surface of the second resistor and the contact point of the movable contact are not greatly damaged and thus have a long life.

The above objects, other features and advantages of this invention will be made more apparent from the detailed description of the preferred embodiments thereof taken in conjunction with the accompanying drawing.

DESCRIPTION OF THE PREFERRED EMBODIMENT

Figure 1:
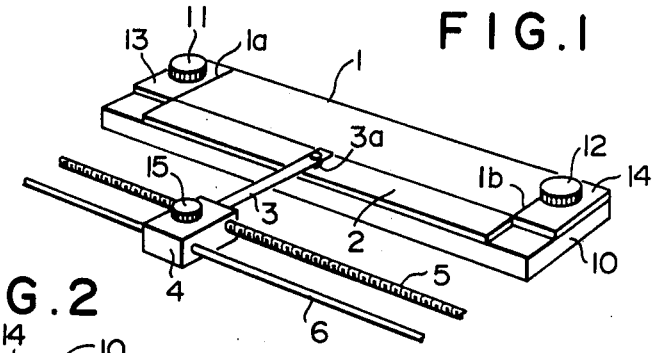
FIG. 1 is a perspective view of an embodiment of the potentiometer in accordance with the present invention.

FIG. 1 shows an embodiment of the potentiometer in accordance with the present invention which employs straight resistors arranged in parallel in side by side relation. The potentiometer shown in FIG. 1 is composed of a first resistor 1 having comparatively low resistance, a second resistor 2 having comparatively high resistance arranged in parallel to and in side by side relation with the first resistor 1, and a movable contact 3 slidable along the two resistors in slidable contact with the second resistor of high resistance. The first resistor 1 of low resistance is provided at both ends thereof with input terminals 11 and 12.

The first and second resistors 1 and 2 are disposed on an insulating base plate 10. The resistors 1 and 2 are made, for example, of burned paste or a vacuum evaporated material applied to the surface of the insulating base plate 10 in side by side relation as shown in FIG. 1. A pair of conductive parts 13 and 14 made of conductive material such as silver paste are disposed on the base plate 10 in contact with the both ends 1*a* and 1*b* of the first resistor 1. Said input terminals 11 and 12 are fixed to the conductive parts 13 and 14, respectively.

The movable contact 3 has a contact point 3*a* which is in slidable contact with the surface of said second resistor 2 of high resistance and is fixed to a slidable member 4 which is in screw engagement with and movable along a screw rod 5 extending in parallel to said resistors 1 and 2 as the screw rod 5 revolves. The slidable member 4 is further slidable engaged with a guide rail 6 extending in parallel to the screw rod 5. The slidable member 4 is made of an insulating material and is provided with an output terminal 15 which is electrically connected to the movable contact 3.

Figure 2:
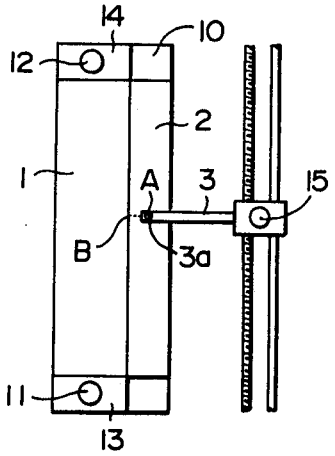
FIG. 2 is a plan view of the potentiometer as shown in FIG. 1.
Figure 3:
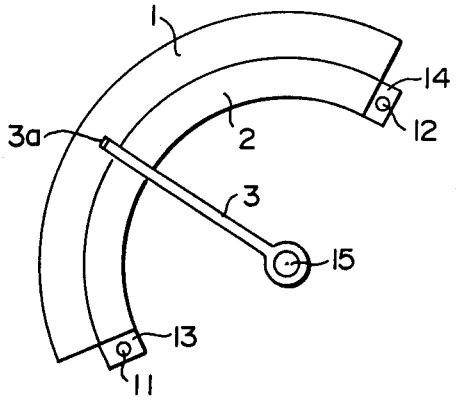
FIG. 3 is a plan view of another embodiment of the potentiometer in accordance with the present invention.

FIG. 3 shows another embodiment of the potentiometer in accordance with the present invention. In this embodiment, all the elements equivalent to those shown in FIG. 1 are designated with the same reference numerals. In this second embodiment, a first resistor 1 and a second resistor 2 are arcuate in form and a movable contact 3 is swingable about an axis. Other elements and structures are all the same as those of the first embodiment as shown in FIGS. 1 and 2.

Figure 4:
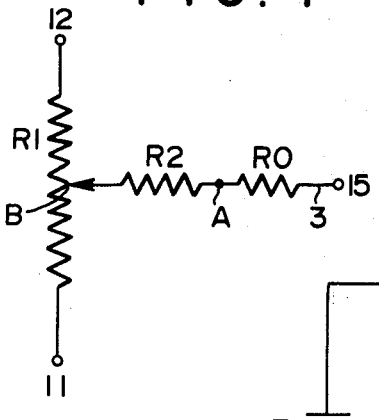
FIG. 4 is a circuit view of an equivalent circuit of the potentiometer in accordance with the present invention.

The electric characteristics of the above described potentiometers shown in FIGS. 1 to 3 can be represented by an equivalent circuit as shown in FIG. 4, in which the elements equivalent to those shown in FIGS. 1 to 3 are all designated with like reference numerals. In FIG. 4, a resistor R1 is connected between a pair of input terminals 11 and 12. A movable contact 3 with at an end thereof an output terminal 15 is connected with a second resistor R2 by way of a contact point A. A resistor R0 shown between the output terminal 15 and the contact point A represents the contact resistance between the contact point 3*a* of the movable contact 3 and the surface of the second resistor 2. There is a second resistor R2 between the contact point A and a point B on the first resistor R1. The point B represents the point on the side of the first resistor 1 which is in contact with the second resistor 2 and which is at the position closest to said contact point 3*a* of the movable contact. These points A and B are shown in FIG. 2. Therefore, the point B moves along the edge of the first resistor 1 as the movable contact 3 moves along the second resistor 2. The second resistor R2 shown in FIG. 4, therefore, represents the resistance of a part of the second resistor 2 lying between the contact point 3*a* (or A) and the point B.

In the equivalent circuit as shown in FIG. 4, the second resistor R2 does not change since the distance between the contact point 3*a* of the movable contact 3 and the edge of the first resistor 1 does not change as the movable contact 3 moves along the second resistor 2. The contact resistance R0 between the contact point 3*a* of the movable contact 3 and the surface of the second resistor 2 is somewhat changed as the movable contact 3 moves along the surface of the second resistor 2. However, since the contact resistance R0 is much smaller than the second resistance R2, the change in the contact resistance R0 is negligible. Further, as explained hereinafter, the resistance of the contact resistance R0 and the second resistor R2 is negligible with respect to the divided voltage effected by the division of the first resistor R1 by use of an amplifier of high input impedance connected with the output terminal 15 of the potentiometer.

In the practical circuitry, the first resistor R1 has several hundred to several thousand ohms, the second resistor R2 has several hundred kiloohms to several megaohms and the contact resistance R0 is several milliohms to several ohms. Therefore, the contact resistance R0 is negligible with respect to the resistance of the second resistor R2. Further, when the output of the potentiometer is amplified through an amplifier with a high input impedance of $10^9$ to $10^{10}$ ohms, the resistance of the second resistor R2 and the contact resistance R0 are negligible.

Figure 5:
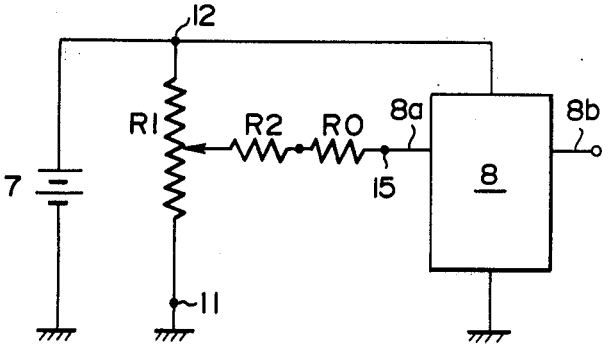
FIG. 5 is a circuit view of an example of an electric circuit employing the potentiometer in accordance with the present invention.

An example of an electric circuit which employs the potentiometer in accordance with the present invention will hereinbelow be described with reference to FIG. 5. Two input terminals 11 and 12 of the first resistor R1 are connected to the positive and negative terminals of an electric power source 7. The output terminal 15 of the potentiometer is connected to an input 8*a* of an amplifier 8 with a high input impedance. The output voltage of the potentiometer at the output terminal 15 therefore is taken at the output 8*b* of the amplifier 8. Since the input impedance of the amplifier 8 is much higher than the resistance of the second resistor R2 and the contact resistance R0, the resistance is negligible.

In the potentiometer in accordance with the present invention, the movable contact 3 slides along the second resistor of high resistance. Therefore, there flows a small amount of electric current through the contact point between the movable contact and the second resistor. Accordingly, the surface of the resistor and the contact is not damaged by sparks and has high durability.

The amplifier 8 which has a high input impedance can easily be obtained, for instance, by attaching a source follower circuit of an FET to the input of an amplifier. Further, there have been know various transistor amplifiers with a high input impedance.

We claim:

1. A potentiometer comprising a first resistor having input terminals at both ends thereof, said first resistor having a side edge extending between the input terminals, a second resistor extending along said side of the first resistor, said second resistor having a side which is in line contact with said side of the first resistor, the resistance of said first resistor being substantially lower than that of said second resistor, a movable contact slidable substantially parallel to said side of the first resistor in slidable contact with said second resistor to thereby establish a resistive path from said movable contact to the point on said first resistor nearest said movable contact, said movable contact having an output terminal fixed thereto and an amplifier connected to said output terminal of the movable contact, the input impedance of said amplifier being substantially greater than that of said resistive path.

2. Potentiometer as defined in claim 1 wherein said first and second resistors are straight in shape and extend in parallel to each other.

3. A potentiometer as defined in claim 2 wherein said movable contact is movable along a straight guide means.

4. A potentiometer as defined in claim 3 wherein said movable contact is fixed to a slidable member which is screw engaged with a screw rod and movable along the screw rod by the rotation of the same.

5. A potentiometer as defined in claim 1 wherein said first and second resistors are arcuate in shape and extend concentrically with each other.

6. A potentiometer as defined in claim 5 wherein said movable contact is swingable about an axis, said axis being located at the center of said arcuate resistors.

* * * * *